US011434058B2

(12) United States Patent
Olsen et al.

(10) Patent No.: US 11,434,058 B2
(45) Date of Patent: Sep. 6, 2022

(54) DIVISIBLE CONTAINER CARRIER

(71) Applicant: ILLINOIS TOOL WORKS INC., Glenview, IL (US)

(72) Inventors: Robert C. Olsen, Medinah, IL (US); Christopher J. Ludwig, Buffalo Grove, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 62 days.

(21) Appl. No.: 15/366,941

(22) Filed: Dec. 1, 2016

(65) Prior Publication Data

US 2017/0158403 A1 Jun. 8, 2017

Related U.S. Application Data

(60) Provisional application No. 62/262,593, filed on Dec. 3, 2015.

(51) Int. Cl.
*B65D 71/50* (2006.01)
*B65D 79/00* (2006.01)

(52) U.S. Cl.
CPC ..... *B65D 71/504* (2013.01); *B65D 79/00* (2013.01); *B65D 2203/06* (2013.01)

(58) Field of Classification Search
CPC .. B65D 71/504; B65D 79/00; B65D 2203/06; B65D 71/506; B65D 71/00; B65B 17/025
USPC ..... 206/150, 161, 143, 153, 151, 175, 145, 206/162, 147, 158, 155, 427; 294/87.2
See application file for complete search history.

(56) References Cited

U.S. PATENT DOCUMENTS 2,604,354 A * 7/1952 Gray ..... B65D 71/50 294/159
3,664,497 A * 5/1972 Mascia ..... B65D 17/4012 206/151
3,778,096 A * 12/1973 Smith ..... B65D 71/504 294/87.2
3,784,002 A * 1/1974 Owen ..... B65D 71/50 206/158
4,155,502 A * 5/1979 Forte ..... B65D 71/48 206/194

(Continued)

OTHER PUBLICATIONS

PCT International Search Report, Form PCT/ISA/210, dated Feb. 17, 2017, (5 pages).

(Continued)

*Primary Examiner* — J. Gregory Pickett
*Assistant Examiner* — Jenine Pagan
(74) *Attorney, Agent, or Firm* — Pauley Erickson & Swanson

(57) ABSTRACT

A flexible carrier for carrying a plurality of containers includes a flexible sheet having two or more rows and multiple ranks of container apertures formed therein. The plurality of containers are each placed into a respective container receiving aperture and are thus unitized in a package. The flexible carrier further includes a plurality of handles corresponding with the multiple ranks, each handle formed at a periphery of the flexible sheet and a line of weakness formed between the transverse ranks. As a result of the described configuration, the flexible carrier is divisible into multiple sub-carriers, each unitizing a set of containers and each including a handle along a respective transverse edge of the resulting sub-carrier.

9 Claims, 3 Drawing Sheets

(56) References Cited

U.S. PATENT DOCUMENTS

| | | | | | |
|---|---|---|---|---|---|
| 4,985,980 | A * | 1/1991 | Gould | B65D 71/504 | 29/525.01 |
| 5,038,928 | A | 8/1991 | Marco et al. | | |
| 5,511,656 | A * | 4/1996 | Olsen | B65D 71/504 | 206/150 |
| 5,609,379 | A * | 3/1997 | Harrelson | B65D 71/44 | 206/192 |
| 5,624,024 | A * | 4/1997 | Miess | B65D 71/004 | 206/172 |
| 5,868,659 | A * | 2/1999 | Slomski | B65D 71/504 | 206/150 |
| 6,148,994 | A * | 11/2000 | Olsen | B65D 71/504 | 206/150 |
| 6,182,821 | B1 * | 2/2001 | Olsen | B65D 71/504 | 206/150 |
| 7,806,257 | B2 * | 10/2010 | Samaras | B65B 17/02 | 206/150 |
| 2004/0256251 | A1 * | 12/2004 | Weaver | B65D 71/504 | 206/162 |
| 2005/0241963 | A1 * | 11/2005 | Slomski | B65D 71/504 | 206/150 |
| 2009/0045081 | A1 * | 2/2009 | Hamann | B65D 23/003 | 206/161 |
| 2015/0108014 | A1 * | 4/2015 | Olsen | B65D 23/102 | 206/150 |

OTHER PUBLICATIONS

PCT Written Opinion of the International Searching Authority, Form PCT/ISA/237, dated Feb. 17, 2017, (6 pages).

* cited by examiner

DIVISIBLE CONTAINER CARRIER

CROSS-REFERENCE TO RELATED APPLICATIONS

This application claims priority to U.S. Provisional Applications, Ser. No. 62/262,593, filed on 3 Dec. 2015. This U.S. Provisional Application is hereby incorporated by reference herein in its entirety and are made a part hereof, including but not limited to those portions which specifically appear hereinafter.

BACKGROUND OF THE INVENTION

Field of the Invention

This invention relates to a flexible carrier for carrying a plurality of containers such as cans or bottles.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers may be used to unitize groups of four, six, eight, twelve or other suitable groups of containers into a convenient multi-package. One problem encountered with conventional multi-packages, such as six packs and twelve packs, is a lack of flexibility for the merchandiser. If the merchandiser stocks only six packs, then the consumer cannot purchase a smaller package. This merchandising problem is especially acute for smaller, low-volume merchandisers which do not have the shelf space or the inventory capabilities to stock multiple sizes of multi-packages.

Merchandisers have attempted several solutions of the above problem. Some merchandisers use a utility knife to cut multi-packages into smaller sub-packages, resulting in an unstable package, generally without an effective handle for the consumer. Some merchandisers purchase multiple cardboard flats of loose containers and re-package the containers on the premises according to demand. This procedure is time consuming and also results in unstable and inconsistent multi-packages.

Both of the above inadequate solutions also result in multi-packages that must be re-priced according to the size of the multi-package. Often universal bar code ("UPC") symbols, bar codes or other means of pricing reflect the price of the previously sized multi-package, thus resulting in improper scans and incorrect labeling of the re-packaged multi-package.

SUMMARY OF THE INVENTION

The present invention is directed to a flexible carrier for packaging containers that includes an arrangement of container apertures that are divisible along a line of weakness. A handle is preferably positioned along at least one side of each rank of the flexible carrier for grasping the carrier from a transverse edge of the resulting divided package.

According to preferred embodiments of this invention, each flexible carrier preferably includes two or more longitudinal rows and transverse ranks of container apertures, each for receiving a container, to form a package. A severable line of weakness extends between the ranks of container apertures that may be separated by the retailer prior to sale. Each resulting sub-carrier preferably forms a self-contained multi-package with a discrete handle for carrying the sub-carrier and may include a discrete labeling system for correct scanning of the resulting multi-package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 8:
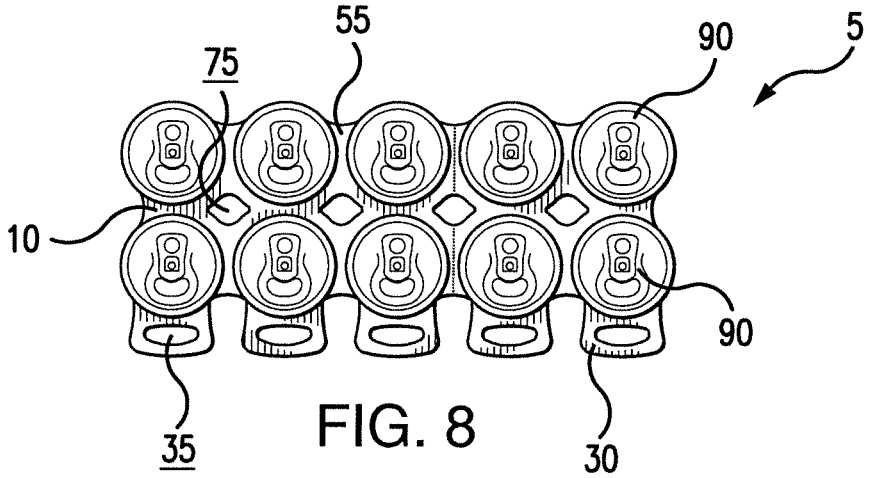
FIG. 8 shows a schematic top view of a package of unitized containers according to one preferred embodiment of this invention.

FIGS. 1-7 show a flexible carrier 10 for unitizing a plurality of containers in transverse ranks and longitudinal rows to form a unitized package that is divisible between each rank. FIG. 8 shows a schematic of a package 5 of unitized containers 90. Although FIGS. 1-8 illustrate various structures for flexible carrier 10 and a package of the invention, the illustrations are exemplary, and the invention is not limited to the flexible carriers 10 shown.

A carrier 10 is used to unitize a plurality of appropriate containers, preferably cans or bottles. However, any other commonly unitized container may be used with the flexible carrier 10 according to this invention. Containers are preferably like-sized within a single flexible carrier 10, such as shown schematically in FIG. 8.

A package 5 resulting from the flexible carrier 10 includes a plurality of unitized containers 90 as shown schematically in FIG. 8. Flexible carriers 10 are generally applied to such containers 90 by stretching the flexible sheet 20 surrounding container apertures 25 around a perimeter of the container, and allowing the stretched carrier 10 to recover, thereby providing a tight engagement. The flexible carrier 10 is typically applied to a chime or rib of a container, where this structure exists, or to a main sidewall.

Each flexible carrier 10 preferably includes the flexible sheet 20 having a width and length defining therein a plurality of container apertures 25, each for receiving a container. The plurality of container apertures 25 are preferably arranged in longitudinal rows and transverse ranks so as to form an array of container apertures 25, such as two rows by six ranks for a twelve container multi-package; three rows by four ranks for a twelve container multi-package, etc. Ranks may be additionally separated from adjacent ranks with a dividing aperture 75.

Container apertures 25 are preferably elongated in a longitudinal direction of flexible carrier 10. Each container aperture 25 preferably includes a flat outer edge and a contoured inner edge. Specifically, the contoured inner edge may take the form of a tab or flap that extends into the container aperture from a center band of the flexible carrier 10.

As shown in the figures, each flexible carrier 10 further includes a plurality of handles 30, each handle 30 formed at a periphery of each rank of the flexible sheet 20 along each longitudinal edge of the flexible sheet 20. As such, a six rank carrier 10 includes six handles 30.

Figure 3:
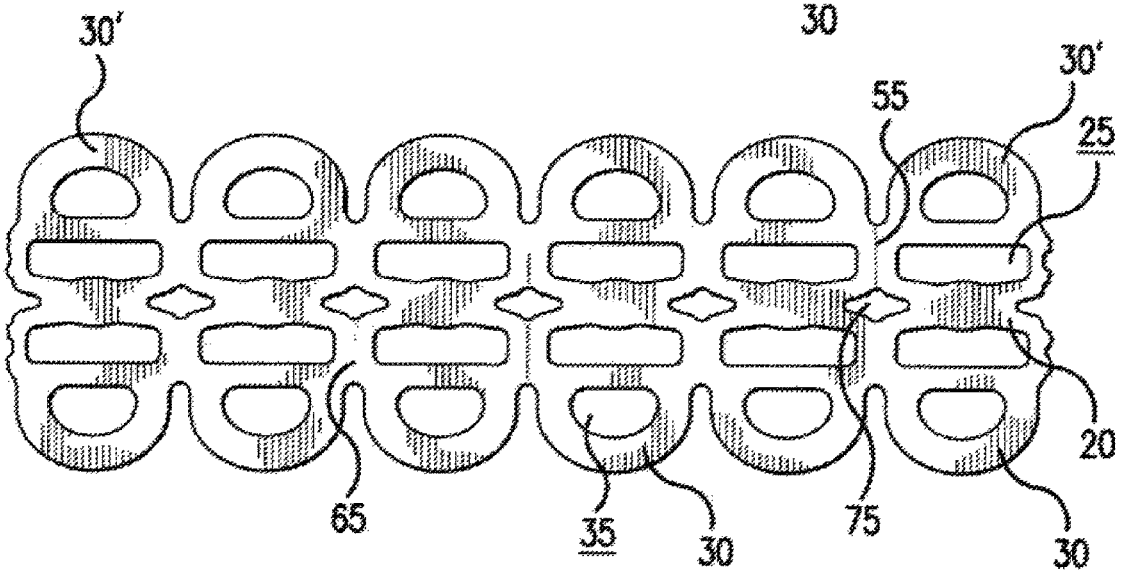
FIG. 3 is a top view of a flexible carrier according to one preferred embodiment of this invention.
Figure 4:
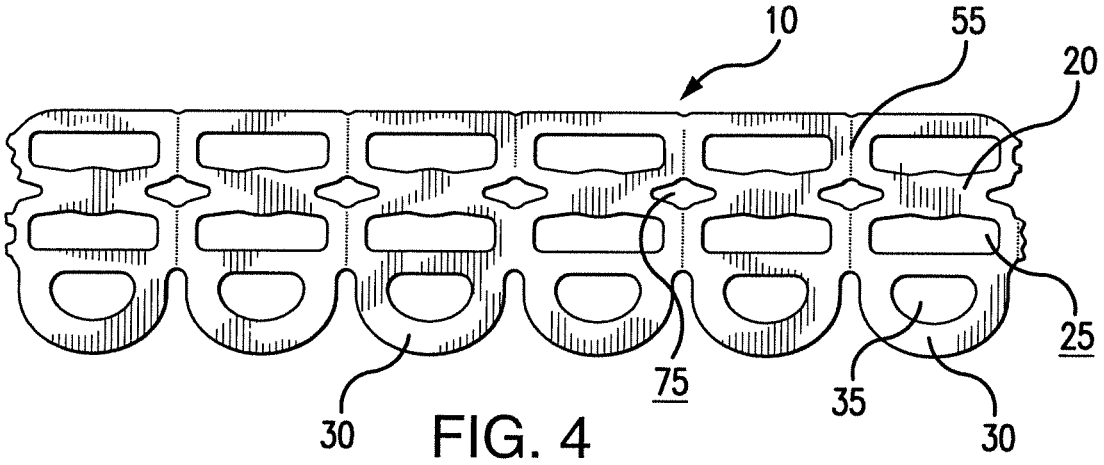
FIG. 4 is a top view of a flexible carrier according to one preferred embodiment of this invention.
Figure 5:
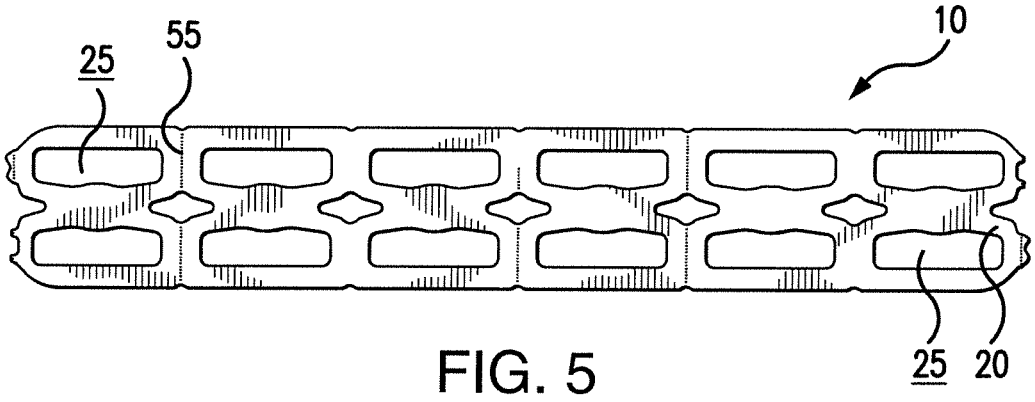
FIG. 5 is a top view of a flexible carrier according to one preferred embodiment of this invention.
Figure 6:
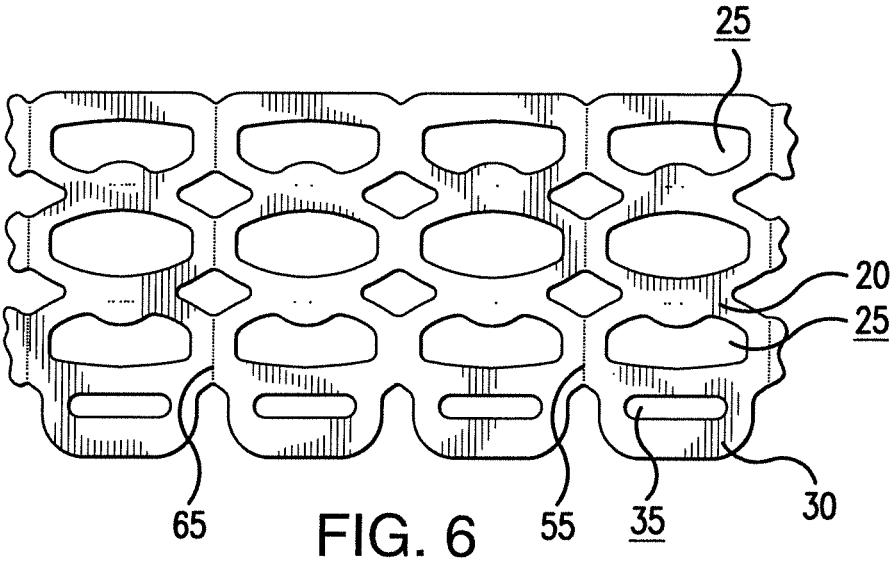
FIG. 6 is a top view of a flexible carrier according to one preferred embodiment of this invention.
Figure 7:
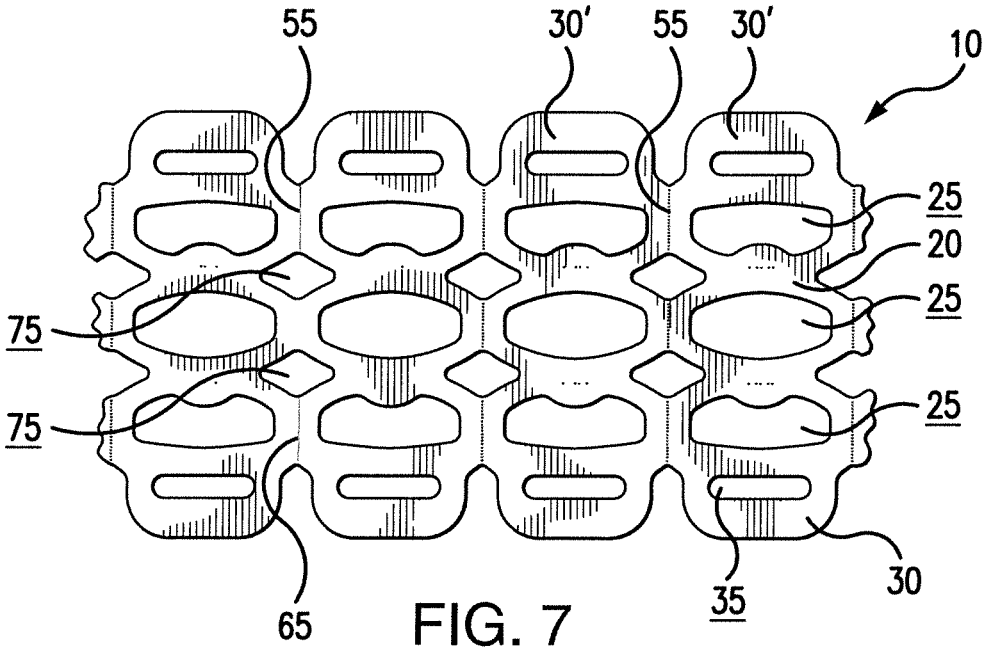
FIG. 7 is a top view of a flexible carrier according to one preferred embodiment of this invention.

Further, in an embodiment shown in FIG. 3, a handle 30 may be positioned on each side of each rank such that each rank includes two handles 30, 30', one handle on each of opposite sides of the same rank. This "second" plurality of handles 30' are preferably arranged along an opposite longitudinal edge of the flexible sheet opposite the first plurality of handles. Each handle 30, 30' is preferably suitable for manual grasping and extends from each longitudinal edge 40 to permit carrying of package 16 formed by flexible carrier 10 and the plurality of containers.

Figure 1:
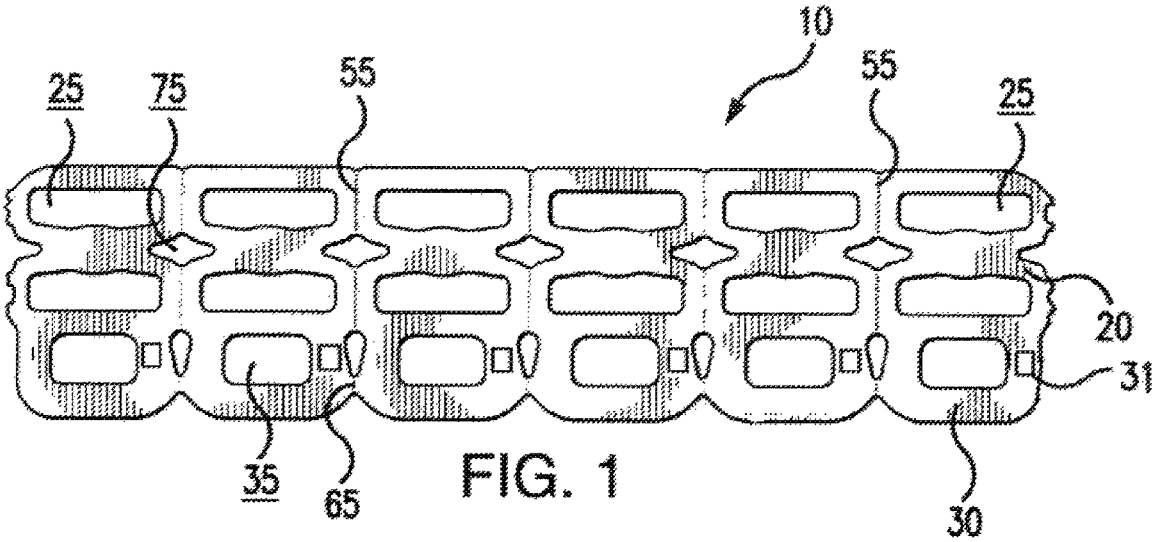
FIG. 1 is a top view of a flexible carrier according to one preferred embodiment of this invention.
Figure 2:
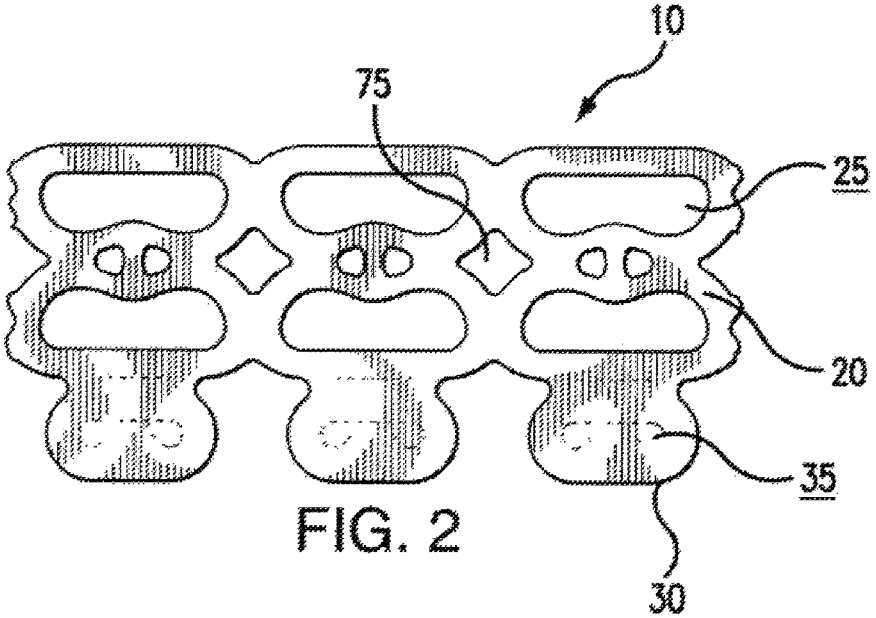
FIG. 2 is a top view of a flexible carrier according to one preferred embodiment of this invention.

The handle 30 is preferably positioned relative to flexible sheet 20 so as to extend from a periphery of flexible sheet 20, along a longitudinal edge of flexible sheet. However, when a package is sub-divided, the resulting sub-package includes the handle 30 along the transverse, or shorter edge, of the resulting sub-package or sub-carrier. The handles 30 may be affixed to the flexible sheet 20 at two attachment points such as shown in FIG. 1 or at a single attachment point such as shown in FIG. 2.

The handle 30 may comprise one or more elongated handle apertures 35 positioned along the outer periphery of the handle 30 or may comprise a similar configuration that provides an ample area for a consumer to grasp, by inserting a hand within and through, and still maintain the purpose and integrity of the resulting package. The handle aperture 35 preferably includes a width greater than a corresponding container aperture 25 in a respective rank. The handle 30 preferably forms a handle aperture 35 within the flexible carrier 10 and, as described in more detail below, is capable of supporting the weight of the resulting package when grasped by a consumer. As a result of the configuration of the handle 30 relative to flexible sheet 20, including the handle aperture 35, it should be apparent to a consumer that handle 30 is intended for grasping and lifting of the package 5.

Each handle 30 may further include universal bar code ("UPC") symbols, price labels or other means of pricing to reflect the price of the resulting sub-package. When divided, each handle 30 may preferably be scanned to obtain the correct product and pricing information.

The flexible carrier 10 may further include a separable joint 65 positioned between each adjacent handle 30 of the plurality of handles 30, such as shown in FIGS. 1, 3, 4, 6 and 7. This separable joint 65 particularly helps maintain alignment of the generally continuous string of container carriers 10 during manufacture and application.

The flexible carrier 10 further includes line of weakness 55 formed between the transverse ranks of container apertures 25 in what is commonly called the transverse direction of flexible carrier 10, i.e., perpendicular to the direction in which flexible carrier 10 is extruded and punched into form. The line of weakness 55 may comprise a perforation, slits, a thickness reduction in flexible sheet 20 or any other suitable weakening of flexible carrier 10 that permits separation of flexible sheet 20 into two or more sub-carriers and, thus, sub-packages.

According to one preferred embodiment of this invention, the line of weakness 55 comprises a uniform or an intermittent perforation extending from near one outer edge of flexible sheet 20 to near an opposite outer edge of flexible sheet 20 and between the transverse ranks of container apertures 25. As used herein, a "uniform" perforation means constant or similarly-sized perforation pattern. As used herein, an "intermittent" perforation comprises a non-uniform perforation such as one that is interrupted by dividing apertures 75 or one that alternates between and/or among differently sized perforations.

As shown in FIGS. 1 and 3-7, the at least one line of weakness 55 comprises two discrete lines of weakness 55 separated by a dividing aperture 75. As such, the line of weakness provides a strong enough connection to keep multiple ranks together if desired but permits separation of such ranks when desired.

In summary, a flexible carrier 10 for carrying a plurality of containers includes the flexible sheet 20 having an array of container apertures 25 and a plurality of handles corresponding with each transverse rank formed at a periphery of the flexible sheet along a longitudinal edge of the flexible sheet. A line of weakness 55 is formed between each rank of container apertures 25 within the flexible carrier 10.

According to a preferred method of operation of the subject flexible carrier 10, a plurality of containers are inserted within the flexible carrier 10, preferably one container in each carrier aperture 25. The resulting unitized package may then be packed and shipped to a retailer or re-seller.

As described above, the package of unitized containers preferably includes a flexible carrier including a flexible sheet and an array of container apertures formed in the flexible sheet and arranged in longitudinal rows and transverse ranks. A plurality of handles corresponding with each transverse rank of the transverse ranks are formed at a periphery of the flexible sheet along the longitudinal edge of the flexible sheet. A line of weakness is formed between each transverse rank. Each container is positioned in a container aperture of the array and the resulting package is dividable into transversely aligned sub-packages of two or more containers. Once divided, each sub-package includes a dedicated handle.

The retailer may then separate flexible carrier 10 and package 16 along one or more of the lines of weakness 55 into two or more sub-carriers and sub-packages, each having a discrete handle 30 along a resulting short or transverse edge of the resulting sub-carrier. As shown in FIG. 1, for example, flexible carrier 10 is separable into six sub-carriers each accommodating two containers. Each sub-carrier and/or sub-package preferably includes proper bar code or similar pricing and quantity information on the resulting sub-package. The retailer may then sell the sub-carrier, for instance six packages of two containers, each grasped along a separate handle 30.

While in the foregoing specification this invention has been described in relation to certain preferred embodiments thereof, and many details have been set forth for purpose of illustration, it will be apparent to those skilled in the art that flexible carrier 10 is susceptible to additional embodiments and that certain of the details described herein can be varied considerably without departing from the basic principles of the invention.

The invention claimed is:

1. A flexible carrier for carrying a plurality of containers, the flexible carrier comprising:

a flexible sheet;

an array of apertures formed in the flexible sheet and arranged in longitudinal rows and transverse ranks, each and every transverse rank of the transverse ranks formed of at least two container apertures and one handle aperture, wherein each handle aperture is formed in one of the longitudinal rows at a periphery of the flexible sheet along the longitudinal edge of the flexible sheet to form a plurality of handles, and the each handle aperture has a width greater than a corresponding container aperture in a respective rank; and a line of weakness extending across the flexible sheet between each adjacent pair of the transverse ranks, wherein the flexible carrier is separable into sub-carriers along the lines of weakness between the each adjacent pair of the transverse ranks, wherein the each and every transverse rank of the sub-carriers has a corresponding one of the plurality of handles, wherein the line of weakness comprises an intermittent perforation interrupted by a separation aperture disposed between adjacent handle apertures of the each adjacent pair of the transverse ranks.

2. The flexible carrier of claim 1 wherein the each and every transverse rank of the transverse ranks, with a corresponding handle aperture, is between two of the plurality of lines of weakness.

3. The flexible carrier of claim 1 further comprising:

a second plurality of handles arranged in a second longitudinal row along an opposite longitudinal edge of the flexible sheet from the plurality of handles.

4. The flexible carrier of claim 1 wherein each container aperture of the array is elongated in a longitudinal direction of the flexible carrier.

5. The flexible carrier of claim 1 wherein the flexible sheet comprises six or more handle apertures.

6. The flexible carrier of claim 1 further comprising a bar code positioned on each of the plurality of handles.

7. The flexible carrier of claim 1 wherein each handle of the plurality of handles is attached to each adjacent handle along the intermittent perforation.

8. The flexible carrier of claim 1 wherein each handle of the plurality of handles is adapted for use with the flexible carrier undivided, and for a corresponding divided sub-carrier separately and individually.

9. The flexible carrier of claim 1 comprising three container apertures in each rank.

* * * * *